US009970699B2

(12) United States Patent
Allard et al.

(10) Patent No.: US 9,970,699 B2
(45) Date of Patent: May 15, 2018

(54) COMBINED REFRIGERATOR/FREEZER APPLIANCES WITH DAMPERS HAVING ICE PREVENTION TREATMENTS

(71) Applicant: Whirlpool Corporation, Benton Harbor, MI (US)

(72) Inventors: Paul B. Allard, Coloma, MI (US); Yen-Hsi Lin, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 868 days.

(21) Appl. No.: 13/975,448

(22) Filed: Aug. 26, 2013

(65) Prior Publication Data

US 2015/0052932 A1 Feb. 26, 2015

(51) Int. Cl.

| | |
|---|---|
| ***F25D 17/04*** | (2006.01) |
| ***F25D 23/02*** | (2006.01) |
| ***F25D 17/06*** | (2006.01) |

(52) U.S. Cl.

CPC ..... *F25D 17/045* (2013.01); *F25D 17/065* (2013.01)

(58) Field of Classification Search

CPC ..... F25D 17/04; F25D 17/065; F25D 21/00; F25D 21/04; F25D 23/02; F24F 13/10

See application file for complete search history.

(56) References Cited

U.S. PATENT DOCUMENTS

| | | | | |
|---|---|---|---|---|
| 6,125,641 | A * | 10/2000 | Kim et al. | 62/187 |
| 6,336,339 | B1 * | 1/2002 | Joung et al. | 62/285 |
| 6,769,263 | B1 | 8/2004 | Armour et al. | |
| 6,910,340 | B2 | 6/2005 | Nowak et al. | |
| 7,131,284 | B2 | 11/2006 | Cushman et al. | |
| 7,152,419 | B1 | 12/2006 | Armour et al. | |
| 7,174,729 | B2 | 2/2007 | Cushman et al. | |
| 2003/0235696 | A1 * | 12/2003 | Byrd | 428/447 |
| 2010/0316806 | A1 * | 12/2010 | He et al. | 427/379 |
| 2012/0045954 | A1 * | 2/2012 | Bleecher et al. | 442/80 |
| 2014/0113144 | A1 * | 4/2014 | Loth et al. | 428/421 |
| 2014/0147627 | A1 * | 5/2014 | Aizenberg et al. | 428/141 |
| 2014/0272301 | A1 * | 9/2014 | Gross et al. | 428/149 |

FOREIGN PATENT DOCUMENTS

| | | |
|---|---|---|
| KR | 100259923 B1 | 6/2000 |

* cited by examiner

*Primary Examiner* — Christopher R Zerphey

(74) *Attorney, Agent, or Firm* — Diederiks & Whitelaw, PLC

(57) ABSTRACT

Combined refrigerator/freezer appliances with dampers having ice prevention treatments are disclosed. An example combined refrigerator/freezer appliance includes a cabinet having a first compartment and a second separate compartment, a refrigeration system including a compressor, a single evaporator and a condenser, the single evaporator being associated with the first compartment to lower temperatures of the first and second compartments, and a damper having a first position in which air is prevented from flowing from the first compartment to the second compartment, and a second position in which air is permitted to flow from the first compartment to the second compartment, wherein at least a portion of the damper is treated to prevent ice buildup from forming on the at least portion of the damper when the damper is in the first position.

15 Claims, 2 Drawing Sheets

12

COMBINED REFRIGERATOR/FREEZER APPLIANCES WITH DAMPERS HAVING ICE PREVENTION TREATMENTS

FIELD OF THE DISCLOSURE

This disclosure relates generally to combined refrigerator/freezer appliances, and, more particularly, to combined refrigerator/freezer appliances with dampers having ice prevention treatments.

BACKGROUND

Combined refrigerator/freezer appliances typically have two or more compartments that are refrigerated to differing temperatures, one being chilled to a temperature well below the freezing temperature of water, such as around 0° F. and the other being chilled to a below ambient temperature, which is above freezing, such as around 40° F. To chill the two different compartments to these temperatures, a refrigeration system is typically employed which includes one or two evaporator components.

In a single evaporator systems, such as those disclosed in U.S. Pat. No. 5,490,395, the evaporator is located in, or in close communication with the freezer compartment, and the evaporator is chilled to below the desired temperature for the freezer compartment. Air is circulated over the evaporator to chill the freezer compartment. To cool the refrigerator or fresh food compartment, air is ducted out of the freezer compartment and is circulated through the fresh food compartment, and then returned to the freezer compartment. A separate fan may be provided for the fresh food compartment air circulation system along with a damper for permitting or preventing the flow of sub-freezing air into the fresh food compartment.

SUMMARY

Combined refrigerator/freezer appliances with dampers having ice prevention treatments are disclosed. An example combined refrigerator/freezer appliance includes a cabinet having a first compartment and a second separate compartment, a refrigeration system including a compressor, a single evaporator and a condenser, the single evaporator being associated with the first compartment to lower temperatures of the first and second compartments, and a damper having a first position in which air is prevented from flowing from the first compartment to the second compartment, and a second position in which air is permitted to flow from the first compartment to the second compartment, wherein at least a portion of the damper is treated to prevent ice buildup from forming on the at least portion of the damper when the damper is in the first position An example damper for use in a combined refrigerator/freezer appliance, the damper includes a housing, and a door having a first position in which air is prevented from flowing from a first compartment of the refrigeration appliance to a second compartment of the refrigeration appliance, and a second position in which air is permitted to flow from the first compartment to the second compartment, wherein at least a portion of the door is treated to prevent ice buildup from forming on the at least portion of the door.

DETAILED DESCRIPTION

Figure 1:
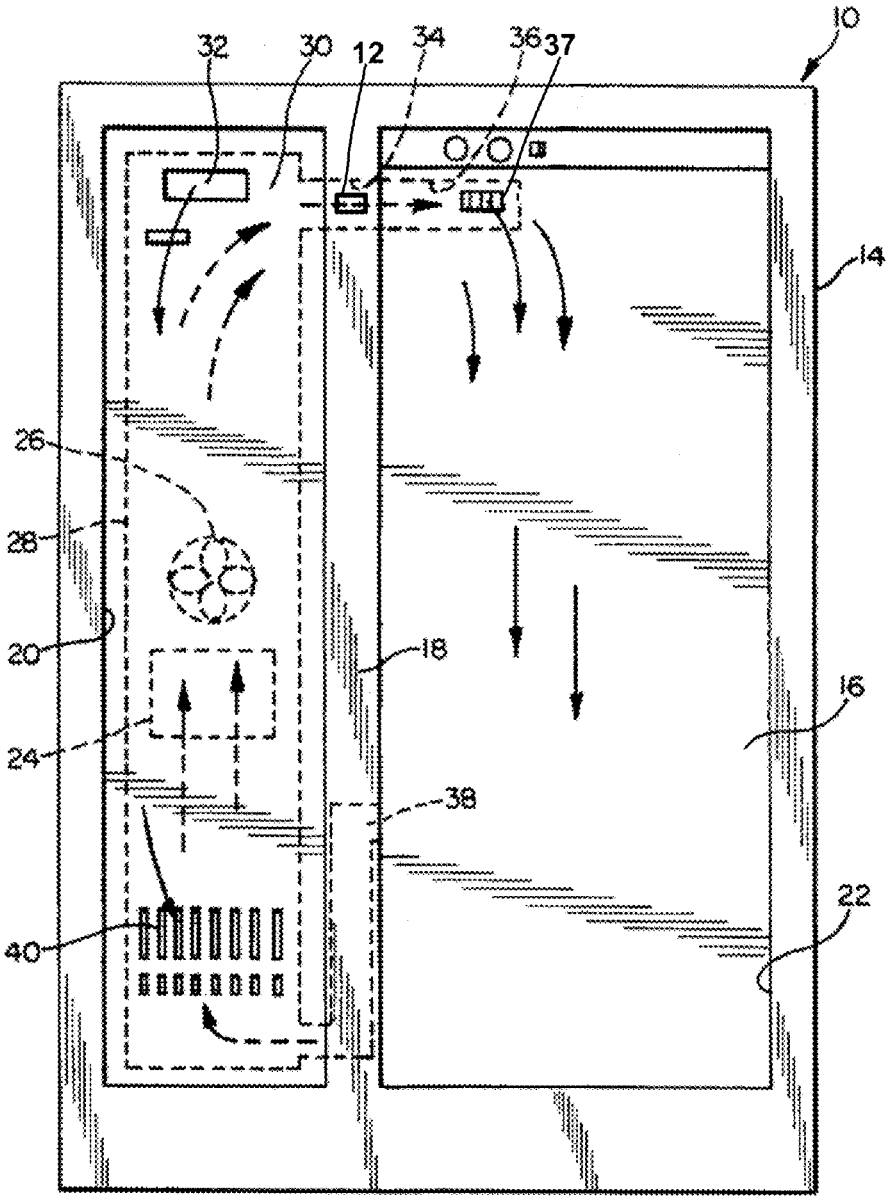
FIG. 1 is a front elevational view of a combined refrigerator/freezer appliance having an air damper constructed in accordance with this disclosure, the compartment doors being omitted to facilitate an illustration of the components therein.

Referring to FIG. 1, a combined refrigerator/freezer appliance 10 having an air damper 12 according to this disclosure is shown. FIG. 1 illustrates a side-by-side refrigerator/freezer. However, other refrigeration appliance configurations may be used in conjunction with the air damper 12, as will be obvious to those skilled in the art.

The refrigerator/freezer 10 includes a cabinet 14 housing a conventional liner 16 therein, with suitable insulation provided between the liner 16 and the cabinet 14. The liner 16 includes a plurality of wall portions, as is well known, and may be of one piece construction or of multiple piece construction, as necessary or desired. The refrigerator/freezer 10 includes an insulated separator or divider wall 18 which may utilize the liner wall portions. The cabinet 14, liner 16 and divider wall 18 together define a below-freezing, or freezer compartment 20, and a fresh food, or above-freezing compartment 22. Suitable doors (not shown) are provided for selective access to the freezer compartment 20 and the fresh food compartments 22.

The freezer and fresh food compartments 20 and 22 are cooled by circulating cooled air therethrough which has been cooled as a result of being passed in heat exchange relation with an evaporator 24. An evaporator fan 26 draws air across the evaporator 24 with the cooled air passing through a duct 28 behind a rear wall 30 of the freezer compartment 20 and further through a freezer compartment air inlet 32. The duct 28 is also in communication with a scoop, or passage 34 in the separator 18. The passage 34 is in communication with an air duct 36 in the upper rear section of the fresh food compartment 22, which duct 36 includes a fresh food compartment air inlet opening 37. The selectively positionable air damper 12 overlies the passage 34 and is operated to control the passage of cooled air into the fresh food compartment 22. The passage 34, the air damper 12, the duct 36 and the opening 37 collectively define an air inlet passageway.

Although the air damper 12 is illustrated as overlying the passage 34, it could be disposed at various positions within the passage 34 and/or the duct 36, as is obvious to those skilled in the art.

Figure 2:
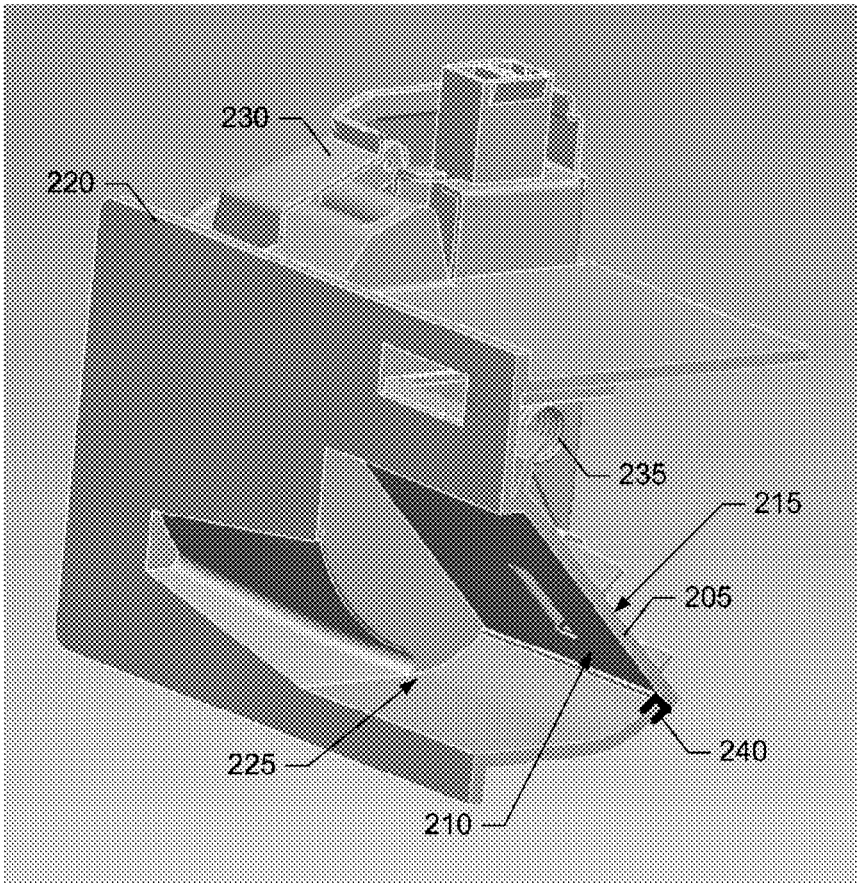
FIG. 2 is a cutaway isometric view of the example air damper of FIG. 1.

The air damper 12 has a door 205 (FIG. 2) having a first position in which air is prevented from passing through the passage 34 (as shown in FIG. 2), and a second position in which air is permitted to pass through the passage 34. When the air damper 12 is in the first position, a first side 210 of the air damper 12 is exposed to air cooled to a temperature below zero while a second side 215 is exposed to warmer moist air of the refrigerator compartment 22. Under such conditions, ice may form on the air damper 12 which may freeze the damper 12 shut thereby preventing the air damper 12 from operating and/or opening to cool the compartment 22. Such conditions may decrease customer satisfaction with a combined freezer/refrigeration appliance. To overcome at least these problems, at least a portion of the example air damper 12 has an ice prevention treatment applied, as described below in connection with FIG. 2.

Cooled air that passes through the passage 34 and the air damper 12 is discharged through the opening 37 to circulate within the fresh food compartment 22 and subsequently return to the freezer duct 28 through a return air outlet duct, or passage 38 located in the separator 18 at the bottom rear of the fresh food compartment 22.

The cooled air in the freezer compartment 20 returns to the duct 28 at a freezer compartment air inlet 40 and mixes with the air returned from the fresh food compartment 22. The mixed air is drawn by the evaporator fan 26 across the evaporator 24 during a cooling unit on cycle to remove heat therefrom and recirculate the air in the compartments 20 and 22.

In addition to the evaporator 24 and the evaporator fan 26, the refrigeration apparatus 10 includes connected components such as a compressor (not shown) and a condenser fan (not shown), a condenser (not shown) and a defrost heater (not shown).

Referring to FIG. 2, the damper 12 has a housing 220 and an opening 225 through the housing 220. The door 215 is hingedly mounted to the housing 220 and is selectively opened and closed by a motor 230. In the example of FIG. 2, a spring 235 biases the door 215 toward a closed position. The door 215 selectively opens and closes the opening 225. In particular, when the door 205 is in a first position, as shown in FIG. 2, air is prevented from passing through the opening 225 and thus prevented from passing through the air damper 12 and the passage 34 (FIG. 1). When the door 205 is in a second or open position (not shown), air is permitted to pass through the opening 225 and thus through the air damper 12 and passage 34.

When the air damper 12 is in the first position (as shown in FIG. 2), the first side 210 of the air damper 12 is exposed to air cooled to a temperature below zero while the second side 215 is exposed to warmer moister air of the refrigerator compartment 22. Under such conditions, frost may form, which reforms into ice on the air damper 12 (and more particularly on the door 205) which may freeze the damper 12 shut thereby preventing the air damper 12 from operating and/or opening to cool the compartment 22. This type of ice has a strong bonding to the air damper 12 (and more particularly on the door 205). To overcome at least these problems, at least a portion of the example air damper 12 has an ice prevention treatment applied, which lowers the surface friction. In some examples, the side 210 of the door 205 has an ice prevention treatment applied. Additionally or alternatively, a portion (e.g., portion 240) of the housing 220 against which the door 205 closes may have an ice prevention treatment applied.

Example ice prevention treatments include, but are not limited to, a melting point depressant, a microtextured plastic surface and/or an icephobic coating. Example icephobic coatings include a silicone, a nanocomposite, and/or a silicon oil infused polydimethylsiloxane (PDMS) coating. In particular, the silicon oil infused PDMS coating has a low surface energy leading to the formation of a loose ice layer. In addition, the oil infused coating reduces the contact area of ice with solid substrate since any ice that forms will contract, which can significantly reduce ice adhesion strength. In some examples, the icephobic coating can be microtextured using soft lithography. If a microtextured plastic surface is used, care has to be taken that the closing force of the door 205 is low enough to not result in surface damage. To reduce such effects, the portion 240 of the housing 220 against which the door 205 closes can be treated with, for example, an elastomer.

While an example damper 12 is shown in FIG. 2, other damper configurations may be used in accordance with the teachings of this disclosure. For example, an air damper 12 having a sliding or rotating door may be used.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. A combined refrigerator/freezer appliance comprising:

a cabinet having a first compartment and a second separate compartment;

a refrigeration system including a compressor, a single evaporator and a condenser, the single evaporator being associated with the first compartment to lower temperatures of the first and second compartments; and a damper having a first position in which air is prevented from flowing from the first compartment to the second compartment, and a second position in which air is permitted to flow from the first compartment to the second compartment, wherein at least a portion of the damper is treated to prevent ice buildup from forming on the at least portion of the damper when the damper is in the first position, wherein treatment of the at least portion of the damper comprises silicon oil infused polydimethylsiloxane coating applied to a surface of the at least portion of the damper.

2. A combined refrigerator/freezer appliance as defined in claim 1, wherein treatment of the at least portion of the damper comprises a melting point depressant applied to a surface of the at least portion of the damper.

3. A combined refrigerator/freezer appliance as defined in claim 1, wherein treatment of the at least portion of the damper comprises an icephobic coating applied to a surface of the at least portion of the damper.

4. A combined refrigerator/freezer appliance as defined in claim 1, wherein the silicon oil infused polydimethylsiloxane coating is microtextured.

5. A combined refrigerator/freezer appliance as defined in claim 4 wherein the silicon oil infused polydimethylsiloxane coating is microtextured using soft lithography.

6. A combined refrigerator/freezer appliance as defined in claim 1, wherein treatment of the at least portion of the damper comprises forming a microtextured surface formed on the at least portion of the damper.

7. A combined refrigerator/freezer appliance as defined in claim 1, wherein the at least portion of the damper comprises a door.

8. A combined refrigerator/freezer appliance as defined in claim 7, wherein the at least portion of the damper comprises a portion of a housing of the damper against which the door seals in the first position.

9. A damper for use in a combined refrigerator/freezer appliance, the damper comprising:

a housing; and a door having a first position in which air is prevented from flowing from a first compartment of the refrigeration appliance to a second compartment of the refrigeration appliance, and a second position in which air is permitted to flow from the first compartment to the second compartment, wherein at least a portion of the door is treated to prevent ice buildup from forming on the at least portion of the door, wherein treatment of the at least portion of the door comprises silicon oil infused polydimethylsiloxane coating applied to a surface of the at least portion of the door.

10. A damper as defined in claim 9, wherein treatment of the at least portion of the door comprises a melting point depressant applied to a surface of the at least portion of the door.

11. A damper as defined in claim 9, wherein treatment of the at least portion of the door comprises an icephobic coating applied to a surface of the at least portion of the door.

12. A damper as defined in claim 9, wherein the silicon oil infused polydimethylsiloxane coating is microtextured.

13. A damper as defined in claim 12, wherein the silicon oil infused polydimethylsiloxane coating is microtextured using soft lithography.

14. A damper as defined in claim 9, wherein treatment of the at least portion of the damper comprises forming a microtextured surface formed on the at least portion of the door.

15. A damper as defined in claim 9, wherein the treatment is applied to at least a portion of the housing against which the at least portion of the door seals in the first position.

* * * * *